United States Patent [19]

Yamazaki

[11] Patent Number: 4,557,085

[45] Date of Patent: Dec. 10, 1985

[54] FIXING MECHANISM FOR STAIR UNITS FACILITATING ADJUSTMENT OF HEIGHT

[76] Inventor: Keiichirou Yamazaki, No. 12-1, 6-chome, Kameido, Koutou-ku, Tokyo-to, Japan

[21] Appl. No.: 530,993

[22] Filed: Sep. 12, 1983

[30] Foreign Application Priority Data

Sep. 14, 1982 [JP] Japan ..... 57-158964
Sep. 14, 1982 [JP] Japan ..... 57-158965

[51] Int. Cl.[4] ..... E04F 11/02

[52] U.S. Cl. ..... 52/182; 52/187; 182/178; 411/427

[58] Field of Search ..... 52/182, 183, 187; 182/178; 411/427, 435

[56] References Cited

U.S. PATENT DOCUMENTS 3,474,882 10/1969 Ernst ..... 52/182 X
4,296,577 10/1981 Schuette ..... 52/187
4,373,609 2/1983 DeDonanto ..... 52/187 X

FOREIGN PATENT DOCUMENTS 2256370 5/1974 Fed. Rep. of Germany ..... 52/182
3031095 7/1982 Fed. Rep. of Germany ..... 52/182
2268918 11/1975 France ..... 52/187
89052 6/1982 Japan ..... 52/182

*Primary Examiner*—Donald G. Kelly
*Assistant Examiner*—Richard E. Chilcot, Jr.
*Attorney, Agent, or Firm*—Martin Smolowitz

[57] ABSTRACT

A fixing mechanism of stair units which are used for assembling a curved stair. Each stair unit has an upwardly projecting cylindrical member and a downwardly projecting cylindrical member at opposite ends. The upwardly projecting cylindrical member of the lower stair unit is inserted into the downwardly projecting member of the upper stair unit rotatably and slidably in the vertical direction. These two cylindrical members are fixed to each other by a screw member disposed on the axis of the upwardly projecting cylindrical member and a pair of nut members, which are engaged with the screw member with clamping an anchor member fixed to the downwardly projecting cylindrical member.

5 Claims, 19 Drawing Figures

FIXING MECHANISM FOR STAIR UNITS FACILITATING ADJUSTMENT OF HEIGHT

BACKGROUND OF THE INVENTION

This invention relates to a fixing mechanism for a stair unit which can assemble a curved stair without the necessity of support poles.

The inventor of the present invention previously proposed a stair unit (Japanese Patent Application No. 163010/1980) having the following construction. As shown in FIGS. 1 and 2, two cylindrical members 1, 2 are juxtaposed in the spaced-apart relation in the vertical direction, and an element 3 having a flat upper surface 3*a* is supported and fixed so that the upper surface 3*a* crosses at right angles the axes Y and Y' of the two cylindrical members 1 and 2. The cylindrical member 1 projects upward beyond the element 3, while another member 2 projects downward from the element 3. The outer diameter of the upwardly projecting cylindrical member 1 is considerably smaller than the inner diameter of the member 2 so that both cylindrical members 1, 2 can be fitted to the corresponding cylindrical members 2, 1 of another stair unit (not shown).

After the stair unit 4 of the type described above is fitted into the cylindrical members of another unit as shown in FIG. 3, both stair units are adjusted so as to attain a predetermined angle and height (h) and are then fixed together via a fixing mechanism (not shown). The same procedures are repeated to complete a curved stair. Incidentally, reference numeral 5 represents a tread, 6 is a floor board and 7 is an upper unit to be fitted to the floor board 6.

On the other hand, the stair fitting position and the distance between a lower floor and an upper floor vary from building to building. In order to have the stair unit wide spread, therefore, a fixing mechanism which can easily adjust the height and angle displacement between the stair units must be developed by all means.

The inventor of this invention proposed previously a fixing mechanism to satisfy the technical requirement described above (Japanese Patent Application No. 68885/1981). The fixing mechanism comprises two lines of round apertures 10 bored in parallel and symmetrically with one another on an upwardly projecting cylindrical member 1, rivet-like pins 11 slidably fitted into the round apertures 10, a conical base 13 having a bolt shaft 12 implanted and fixed vertically onto its axis, a conical base 14 fitted on the upper end of the bolt shaft 12 can penetrate through, and a nut 15 mating with the bolt shaft 12. After the conical bases 13, 14 are arranged so as to oppose each other between the two lines of round apertures 10, the nut 15 is fastened so that both conical bases 13, 14 come close to each other, the pins 11 are pushed outward in consequence and the outer ends of pins 11 are brought into pressure contact with the inner circumferential surface of another cylindrical member 2, thereby fixing the upper unit 4 and the lower unit 4 with each other.

The fixing mechanism described above can certainly adjust the height and can change the angle displacement, but since the cylindrical members 1, 2 are fixed while they are fitted and kept floating, fixing is troublesome and fine adjustment of the height and angle displacement is difficult between the stair units.

The fixing mechanism involves also the following problem in the assembly work. In other words, the assembly is started either from an upper unit 7 that is fitted to the floor board 6 of the second floor or from a lower unit (not shown) that is fitted to the floor board of the first floor, and when the assembly is started from the upper unit, a support means for temporarily supporting each stair unit 4 is necessary in order to prevent the fall of each stair unit 4.

SUMMARY OF INVENTION

In view of the problems with the conventional technique described above, an object of the present invention is to provide a fixing mechanism for stair units which can easily adjust the height and angle displacement and can make easily temporary fixing as well as final fixing of the stair units.

A feature of the present invention resides in a fixing mechanism for stair units which comprises a screw member disposed on the axis of a cylindrical member having a smaller diameter and fixed to the cylindrical member, an anchor member fixed to a cylindrical member having a greater diameter, and a pair of nut members mating with the screw member, and clamping the anchor member from above and below between them.

Hereinafter, the present invention will be described with reference to the accompanying drawings, in which.

DESCRIPTION OF INVENTION

Figure 1:
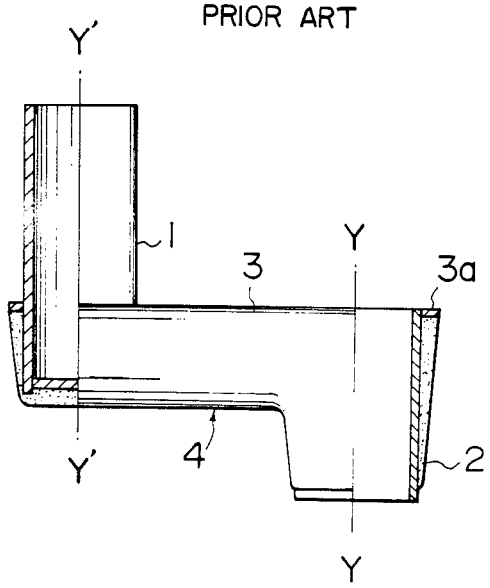
FIG. 1 PRIOR ART
FIG. 1 is a partially sectional front view of a stair unit used in the present invention.
Figure 2:
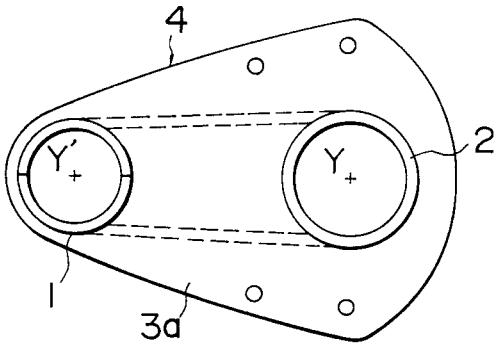
FIG. 2 PRIOR ART
FIG. 2 is a plan view of the stair unit.
Figure 3:
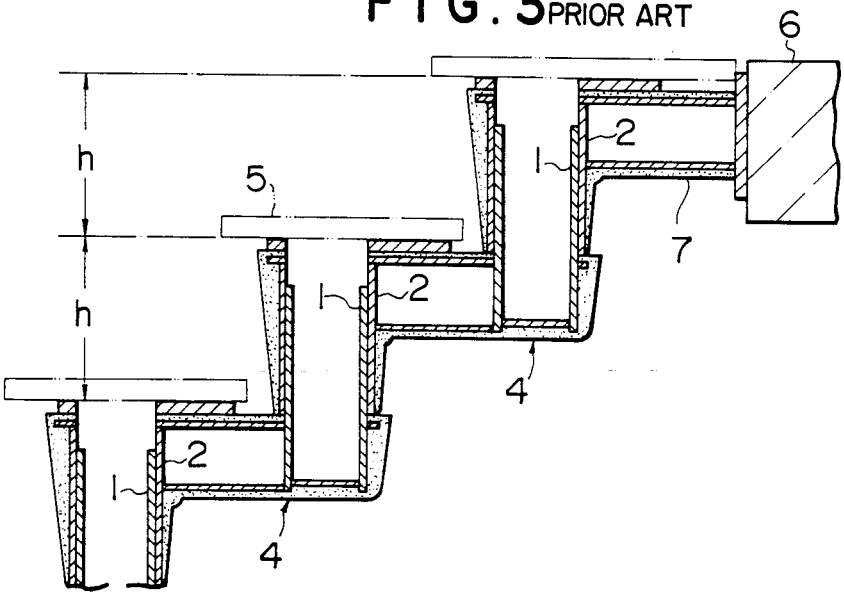
FIG. 3 PRIOR ART
FIG. 3 is a sectional view showing the assembly state of the stair units.
Figure 4:
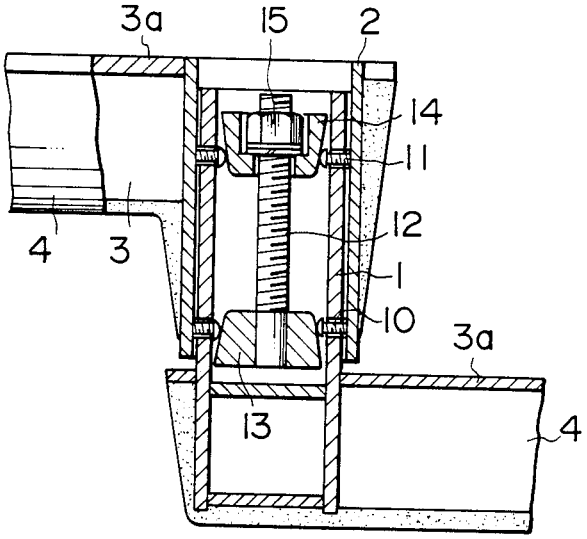
FIG. 4 PRIOR ART
FIG. 4 is a sectional view showing the fixing mechanism in accordance with the prior art.
Figure 5:
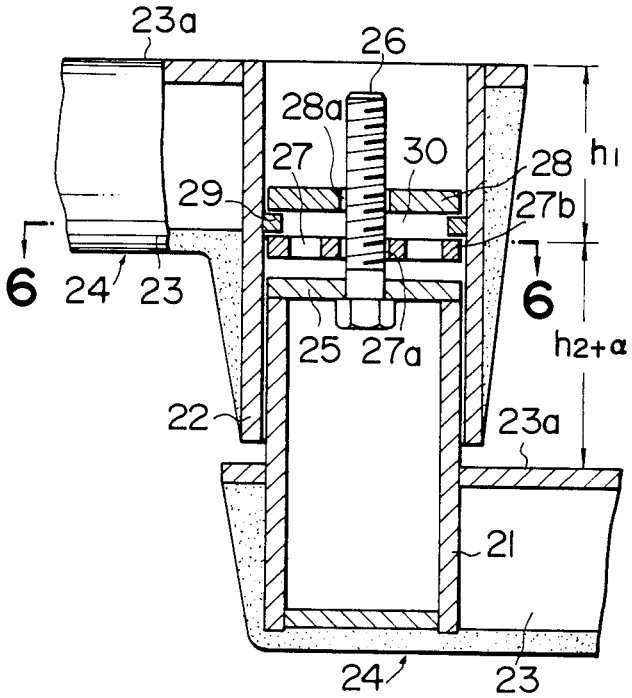
FIG. 5 is a sectional front view of a fixing mechanism of an embodiment of the present invention.
Figure 6:
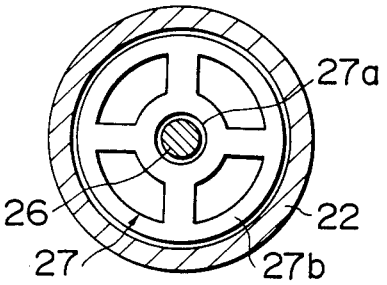
FIG. 6 is a sectional view taken along line 6—6 of FIG. 5.
Figure 7:
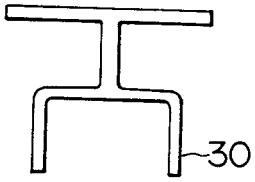
FIG. 7 is a front view of a handle used in the fixing mechanism.

Referring now to FIGS. 5 and 6 showing one embodiment of the present invention, reference numeral 21 represents a cylindrical member of a lower stair unit 24 projecting above an element 23. The cylindrical member 21 is equipped with a screw member 26 that projects upward from its upper end and on its axis via a support member 25. The length of the screw member 26 is such that when an upper stair unit 24 is fitted, the upper end of the screwed shaft does not project from the upper surface 23*a* of the upper element 24.

Reference numeral 22 represents a sylindrical member of the upper stair unit 24 which projects downward from the element 23. As described already, the inner diameter of this cylindrical member 22 is considerably greater than the outer diameter of the cylindrical member 21 of the lower unit 24 and the cylindrical member 21 can be turnably inserted therein. A ring-like anchor member 29 is fixed at an arbitrary position on an inner circumferential surface of the cylindrical member 22. The fixing position of the anchor member 29 is defined by arbitrarily determining the vertical moving range of the upper and lower stair units 24 and 24. (Calculation of the height will be described elsewhere.) Reference numerals 27 and 28 represent a pair of nut members that engage with the screw member 26. Screw holes 27*a*, 28*a* to engage with the screw member 26 are bored at the center of the nut members. The outer shape of each nut member is selected suitably and appropriately such as a round, straight or criss-cross shape so that the nut member can be fitted loosely and turnably into the downwardly projecting cylindrical member 22. Its outer shape is decided so that the nut member can fasten the anchor member 29.

The keel portions of the lower nut member 27 between the outer wheel 27*b* the screw hole 27*a* have a criss-cross shape. The keel portion of the upper nut member between the outer wheel 28*a* and the screw hole 28*a* has a criss-cross shape. Therefore, the lower nut member 27 can be rotated by a two legs-handle 30 through the upper nut member 28.

The action of this embodiment having the construction described above is as follows. First, when the stair unit height is to be adjusted, a desired height (h) between the upper and lower stair units 24 can be obtained as expressed by the following equation by adjusting the height ($h_2+\alpha$) because the height ($h_1$) is constant: Adjustment of the height ($h_2+\alpha$) is done by rotating the lower nut member 27 engaged with the screw member 26.

$$h=h_1+(h_2+\alpha)$$

h: height between the upper stair units 24, and the lower stair unit 24;

$h_1$: height between the upper surface 23*a* of the upper element 23 to the lower surface of the anchor member 29 of the upper stair unit (constant);

$h_2+\alpha$: height from the upper surface of the lower nut member 27 to the upper surface 23*a* of the lower element 23.

The assembly of the upper and lower stair units 24, 24 is carried out on the basis of this calculation formula. It is customary at the site of construction that a difference occurs between the dimension at the site of assembly and that of the drawing. For this reason, it is advisable to make rough adjustment by temporarily assembling the stair units and then to make fine adjustment at the time of final assembly. The present embodiment makes it extremely easy to carry out this two-step adjustment. This is the very difference of the present invention from the prior art.

Figure 8:
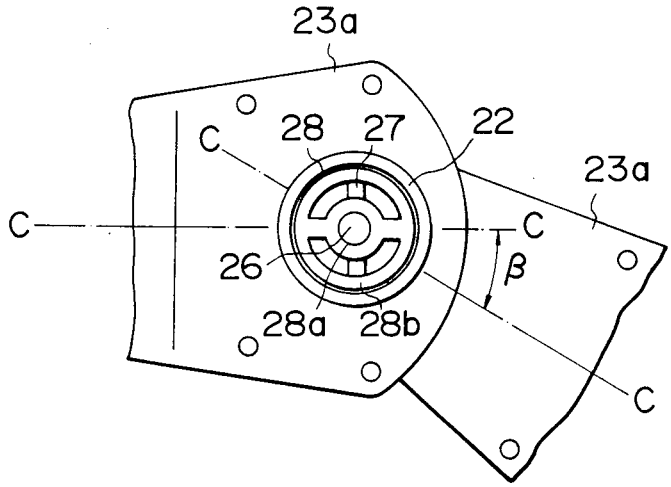
FIG. 8 is a plan view of the fixing mechanism.

The explanation will be made on the case where the assembly is started from the lower unit (not shown). The lower nut member 27 is engaged with the screw member 26 of the cylindrical member 21 of the lower stair unit and then rotated. The height from the upper surface of the nut member 27 to the upper surface 23*a* of the element is adjusted to a desired position of height ($h_2+\alpha$). Next, the cylindrical member 22 of the upper stair unit 24 is inserted from above and the anchor member 29 of the cylindrical member 22 is set on the upper surface of the lower nut member 27. Then, the angle displacement ($\beta$) between both units 24, 24 is adjusted as shown in FIG. 8. Finally, the upper nut member 28 is engaged with the screw member 26 and is temporarily fastened. The same procedures are thereafter repeated for the rest of the stair units to complete the temporary assembly.

After the temporary assembly is finished, confirmation is made whether or not the angle displacement between the upper and lower stair units 24, 24 reaches a predetermined angle, and then the upper unit 7 attached to the second floor board 5 and the lower unit (not shown) attached to the first floor board are completely fixed to predetermined positions of height. Next, in order to distribute the difference between the dimension on the drawing and the dimension at the site of assembly or the error occurring at the time of assembly to each stair unit 24, the lower nut member 27 is roated by the handle 30 through the upper nut member 28, thereby making the fine adjustment of the angle and height. Then, the upper nut member 28 is completely fastened and fixed. The same procedures are thereafter repeated to complete the final assembly.

In the embodiment described above, since the anchor member is fixed to the middle drum portion of the cylindrical member having a large diameter, shake or eccentricity of the axes is likely to occur when the cylindrical members are fitted to each other.

Figure 9:
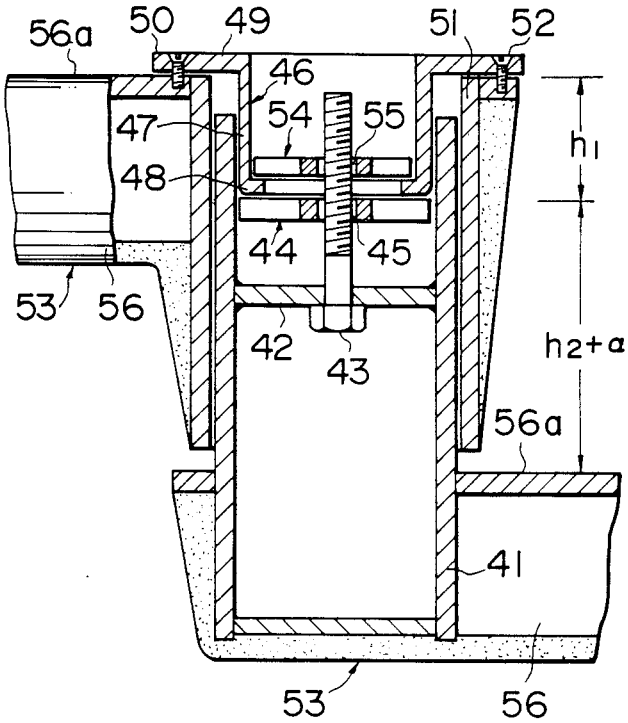
FIG. 9 is a sectional front view of a fixing mechanism of another embodiment of the present invention.
Figure 10:
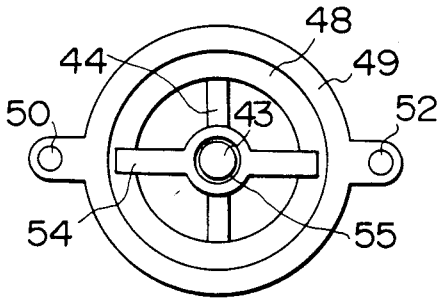
FIG. 10 is a plan view of the fixing mechanism of FIG. 9.

FIGS. 9 and 10 illustrate another embodiment of the invention to eliminate the drawback described above. This embodiment will be described primarily with reference to its difference from the foregoing embodiment.

The length of a cylindrical member 41 having a smaller diameter is determined correspondingly to the vertical movable range of the predetermined height (h) between the stair units. A fixed plate 42 is disposed within the cylindrical member 41 and fixed to the inner surface of its middle portion. A screw member 43 is fixed at the center of the fixed plate 42 so as to project upward along the axis of the plate 42. A lower nut member 44 is equipped at its center with a screw hole 45 mating with the screw member 43. The lower nut member 44 has a criss-cross outer shape so that it can be loosely fitted into the cylindrical member 41. Reference numeral 46 represents an anchor member which consists of a cylindrical body 47 equipped at its lower end with an anchor pattern 48, a flange 49 formed at and around the upper end of the cylindrical body and a pair of screw fitting plates 50 extending outward from the flange 49. The outer diameter of the cylindrical body 47 is sized so that it can be fitted into the cylindrical member 41 having a smaller diameter, and the outer diameter of the flange 49 is sized so that it can be abutted on to the upper end surface of the cylindrical member 51 having a greater diameter. The screw fitting plates 50 are fixed to the upper surface 56*a* of the stair unit 53 by set screws 52. Reference numeral 54 represents an upper nut member, which is equipped at its center with a screw hole 55 mating with the screw member 43. The upper nut member 54 has a straight line-like outer shape so that it can be loosely fitted into the cylindrical body 47 of the anchor member 46.

The action of the FIG. 9 and 10 embodiment will now be described.

When the assembly is started from the upper unit, the lower nut member 44 is engaged with the screw member 43 supported by the cylindrical member 41. Then, the nut member 44 is rotated so that the height from the upper surface of the nut member 44 to the upper surface 56*a* of the lower element 56 is set to a desired height ($h_2$). The lower stair unit 53 thus adjusted is then inserted from below into the cylindrical member 51 of the upper stair unit 53 which is fixed to the further upper unit (not shown). The upper nut member 54 is engaged with the screw member 43 from above the anchor member 46 so as to connect the upper and lower units 53, 53 with each other. Next, the lower stair unit 53 is rotated to adjust the angle and then fastened temporarily.

The same procedures are repeated to complete the temporary assembly, and the difference between the dimension on the drawing and the dimension at the site of assembly or the error occurring at the time of assembly is distributed to each stair unit 53 in the same way as in the foregoing embodiment, namely, by rotating the lower nut member 44 through the upper nut member 54 with the handle 30. After the height ($h_2$) and the angle ($\beta$) are finely adjusted in this manner, the upper nut member 54 is screwed and fixed to complete the final assembly.

This embodiment employs the construction in which the cylindrical member 41 of a smaller diameter is inserted in the cylindrical member 51 of a greater diameter over the substantially entire inner circumferential surface thereof. Therefore, shake or eccentricity of the axes will not occur even when the units 53 are fixed to one another.

In the embodiment described above, the anchor member 46 is fixed to the upper stair unit 53. Therefore, the downward force is always applied to the anchor member 46, when the assembly is started from the upper unit 7. Accordingly, the anchor member 46 may be retained in such a manner as not to move downward without being fixed to the upper stair unit 53. This makes it easy to insert the cylindrical member 41 to the cylindrical member 51.

Figure 11:
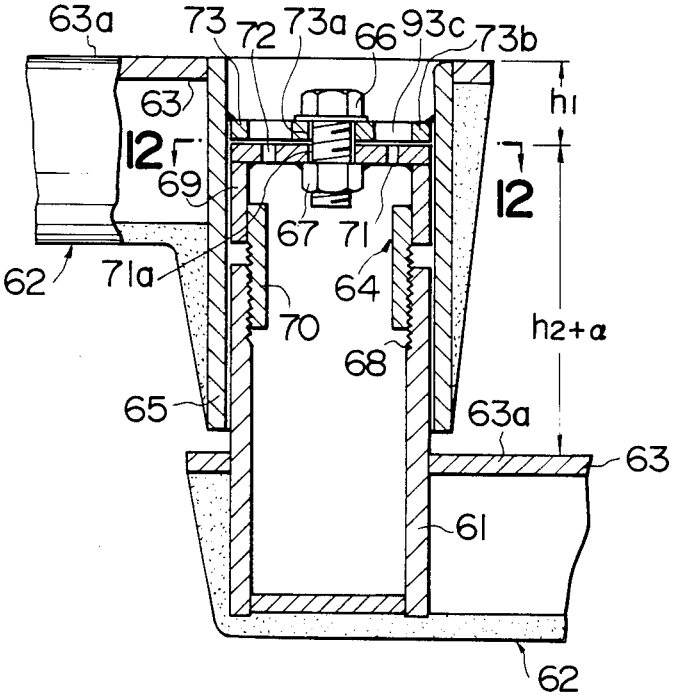
FIG. 11 is a sectional front view of a fixing mechanism of another embodiment of the present invention.
Figure 12:
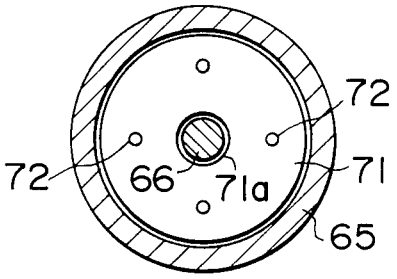
FIG. 12 is a sectional view taken along line 12—12 of FIG. 11.

FIGS. 11 and 12 show other embodiment of the present invention. Reference numeral 61 represents a cylindrical member of a lower stair unit 62 which member projects upward beyond an element 63, and reference numeral 64 represents a moving cylinder screwed to the cylindrical member 61. Reference numeral 65 represents a cylindrical member of an upper stair unit 62 which member projects downward from below the element 63. As described already, the inner diameter of the cylindrical member 65 is considerably greater than the outer diameter of the cylindrical member 61, so that it can be inserted and can rotate freely. Reference numeral 66 represents a bolt and 67 a nut.

The cylindrical member 61 having a smaller diameter is open at its upper end portion and has a thread 68 which is threaded around its inner circumference in a predetermined depth. A moving cylinder 64 consists of a cylindrical tube 69 having an outer diameter equal to that of the cylindrical member 61, another cylindrical tube 70 fixed to the inner circumference at the lower end portion of the cylindrical tube 69 and having a thread around its outer circumference so as to mate with the cylindrical screw portion 68, and a disc-like lid 71 fixed to the upper end of the cylindrical tube 69 and having a bolt hole 71*a* bored on its axis. A nut 67 is fixed on the lower surface of the lid member at a position corresponding to the bolt hole 71*a*. Four holes 72 for receiving a rotating handle similar to the handle 30 are bored around the bolt hole 71*a* in the lid member 71. The downwardly projecting cylindrical member 65 is equipped with a disc-like anchor member 73 at a position considerably below the upper surface 63*a* of the element 63, that is to say, on the inner circumferential surface where the head of the bolt 66 is slightly concealed. A bolt hole 73*a* is bored on the anchor member 73 on its axis. The anchor member 73 includes an outer rim or wheel 73*b* and a radial notch 73*c* around the bolt hole 73*a*, so that the moving cylinder 64 can be rotated by the operating handle from above the anchor member 73 through the notch 73*c*.

The action of the embodiment having the construction described above will be now explained. To adjust the height, a desired height (h) can be obtained as expressed by the following equation by adjusting the height ($h_2+\alpha$), because the height ($h_1$) is constant:

$$h=h_1+(h_2+\alpha)$$

h: height between the upper and lower stair units 62, 62;

$h_1$: height from the upper surface 63*a* of the upper element 63 to the lower surface of anchor member 73 (constant)

$h_2+\alpha$: height from the upper surface of lid member 71 of the moving cylinder 64 to the upper surface 63*a* of the lower element 63.

The assembly of the upper and lower stair units 62, 62 of the present invention is carried out on the basis of the calculation formula described above. As described above, it is advisable to make rough adjustment at the first stage and then to make fine adjustment at the time of final assembly. This embodiment of the invention makes it extremely easy to carry out this two-step adjustment.

The explanation will be first made on the case where the assembly is started from the lower unit (not shown). The moving cylinder 64 is screwed to the screw thread portion 68 of the cylindrical member 61, and then rotated so as to adjust the height from the upper surface of the moving cylinder 64 to the upper surfce 63*a* of the lower element to a desired position of height ($h_2+\alpha$). Next, the cylindrical member 65 of the upper stair unit 62 is inserted from above so that the anchor member 73 of the cylindrical member 65 is put onto the moving cylinder 64. The angle displacement ($\beta$) between the upper and lower stair units 62, 62 is adjusted, and finally, the bolt 66 is inserted through both bolt holes 73*a*, 71*a* and then mated with the nut 67 to carry out temporary fixing. Thereafter, the same procedures are repeated for the rest of stair units to complete temporary assembly of the units.

After the temporary assembly is thus made, confirmation is made whether or not the angle displacement between the stair units 62, 62 of each floor has a predetermined angle, and the upper unit 7 and the lower unit (not shown) attached to the floor boards 6 of the second and first floors, respectively are completely fixed to the positions of predetermined height. Next, in order to distribute the difference between the dimension on the drawing and the dimension at the site of assembly or the error occuring at the time of the assembly to each stair unit, the handle is inserted into the fitting holes 72 of the moving cylinder 64 through the notch 73*c* of the anchor member 73, and then the cylinder 64 is rotated so as to make fine adjustment of the height ($h_2+\alpha$) and the angle ($\beta$). The same procedures are repeated to finish the final assembly.

Figure 13:
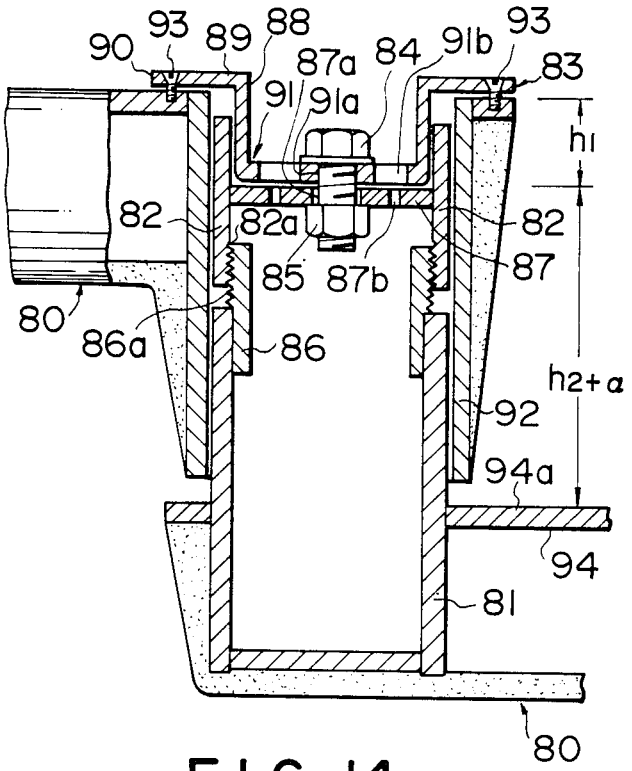
FIG. 13 is a sectional front view of a fixing mechanism of a further embodiment of the present invention.
Figure 14:
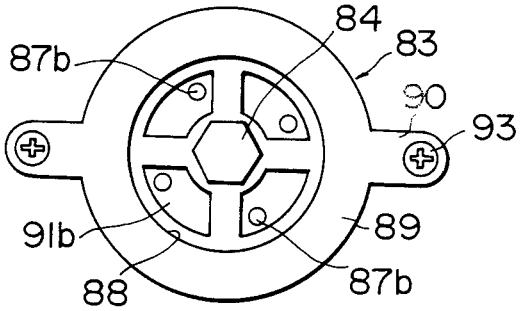
FIG. 14 is a plan view of the fixing mechansim of FIG. 13.

FIGS. 13 and 14 show a further embodiment of the present invention. This embodiment will be described primarily with reference to its difference from the foregoing embodiment.

Numeral 81 represents a cylindrical member with a small diameter having an opening a the top. A cylindrical member 86 equipped with a thread 86*a* of a predetermined length on its outer circumference is fixed at the upper end on the inner circumference of the cylindrical member 81. A moving cylinder 82 has an outer diameter which is the same as that of the cylindrical member 81, and a thread 82*a* is formed on the inner circumference at the lower portion of the cylinder 82. A disc-like fixing plate 87 is fixed at the middle portion of the inner circumference of the cylinder 82. A bolt hole 87*a* is bored on the fixing plate 87 on its axis, and a nut 85 is fixed on the lower surface of the fixing plate 87. A plurality of holes 87*b* for receiving an operating handle similar to the handle 30 described above are formed around the bolt hole 87*a*. The length of the cylinder 82 is decided by arbitrarily determining the vertical movable range of the stair unit 80. An anchor member 83 consists of a recessed cylinder 88, a flange 89 formed around the upper end of the cylinder 88 and a pair of screw fitting plates 90 extending outward from the flange 89. The recessed cylinder 88 is constructed so that it can be inserted into the moving cylinder 82, and openings 91*b* is formed around a bolt hole 91*a* that is bored on the axis of a bottom plate 91 of the cylinder 88. The outer diameter of the flange 89 is sized so that it can be put on the upper surface of a cylindrical member 92 having a greater diameter. The anchor member 83 is fixed to the stair unit by a screw 93 that is fitted to a screw fitting plate 90.

Next, the action of this embodiment will be described.

When the assembly is started from the upper unit, for example, the moving cylinder 82 is screwed to the threaded cylinder 86, that is fixed to the cylindrical member 81, and then rotated so that the height from the upper surface of the fixing plate 87 of the moving cylinder 82 to the upper surface 94*a* of the lower element 94 is adjusted to a desired position of height ($h_2+\alpha$). After the adjustment is thus made, the lower stair unit 80 is inserted from below into the cylindrical member 92 of the upper stair unit 80 fixed to the upper unit 7. Thereafter, bolt 84 is inserted into the bolt hole 87*a* from above the anchor member 83 and is loosely mated with the nut 85, thereby fixing the upper and lower units 80, 80. After the lower stair unit 80 is rotated to adjust the angle, temporary assembly is effected. The same procedures are thereafter repeated to complete the temporary assembly.

After the temporary assembly is thus completed, the moving cylinder 82 is rotated by the handle through the openings 91*b* of the anchor member 93 in order to distribute the difference of the dimension between the dimension on the drawing and the dimension at the site of assembly or the error occurring at the time of assembly to each stair unit. After the fine adjustment of the height ($h_2+\alpha$) and angle ($\beta$) is made, the bolt 84 is screwed and fixed, thereby completing the final assembly.

Since this embodiment has the construction in which the cylindrical member 81 and the moving cylinder 82 are fitted in the cylindrical member 92 at the substantially entire inner circumferential surface thereof, the embodiment can eliminate the problem that shake or eccentricity of axes occurs when the stair units 80, 80 are fixed to each other.

In the embodiment described above, as the anchor member 83 is fixed to the upper stair unit, is started from the upper unit 7, the force always acts downward upon the anchor member 83, when the assembly is started from the upper unit 7. Therefore, the anchor member 83 needs only be supported so as not to move at least downward without the necessity of fixing it to the upper stair unit 80. Thus, the moving cylinder 82 can be inserted more easily.

It is not always necessary that the anchor member 83 be formed integrally. Instead, the bottom plate 91 and the cylinder 88 may be separately made, and may be anchored or supported under the state in which they do not move downward.

Figure 15:
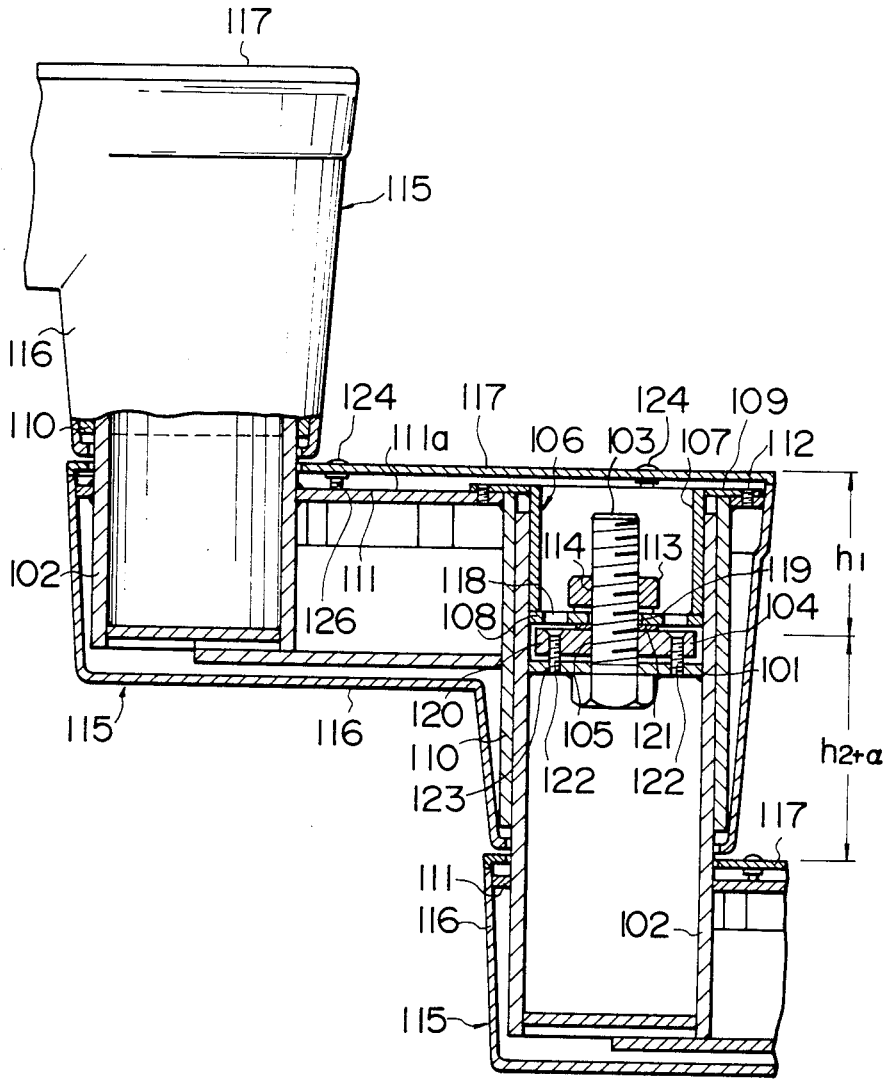
FIG. 15 is a sectional front view of a fixing mechanism of another embodiment of the present invention.
Figure 16:
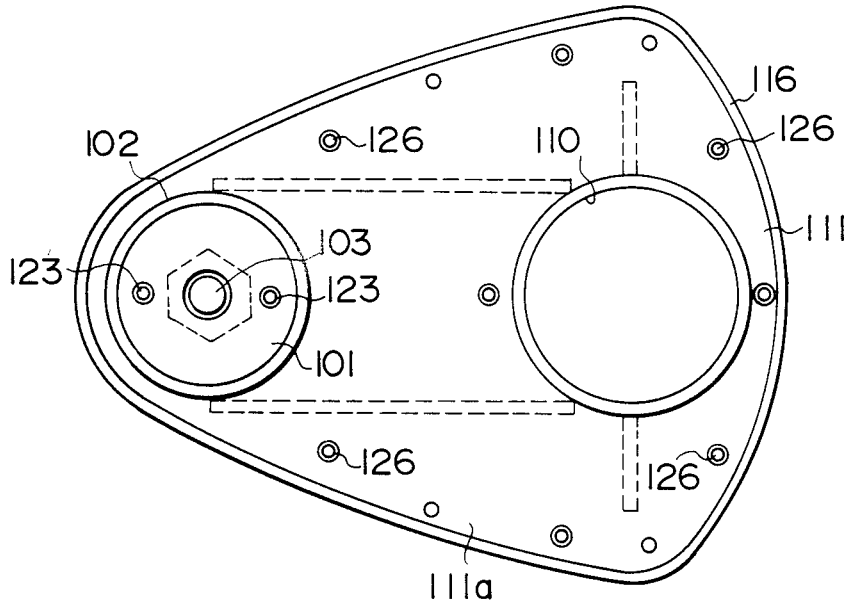
FIG. 16 is a plan view of a stair unit used in the mechanism of FIG. 15.
Figure 17:
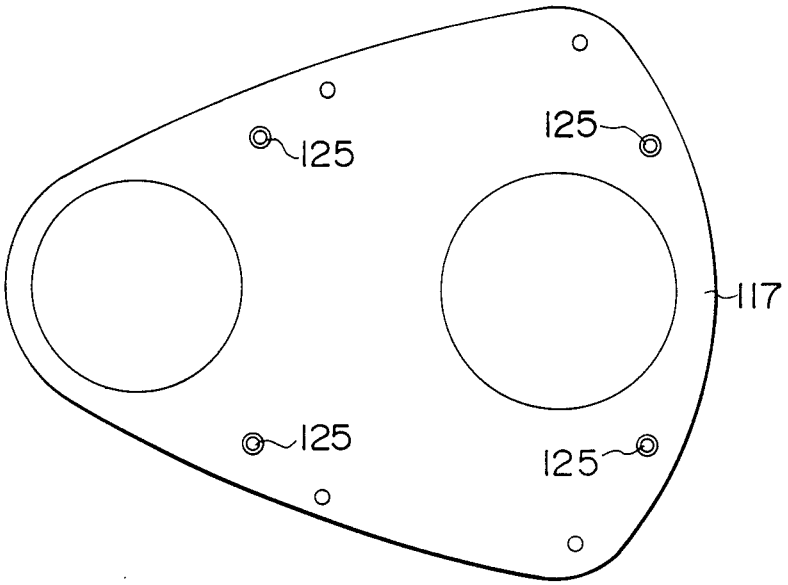
FIG. 17 is a plan view of a level adjusting plate used in the fixing mechanism of FIG. 15.
Figure 18:
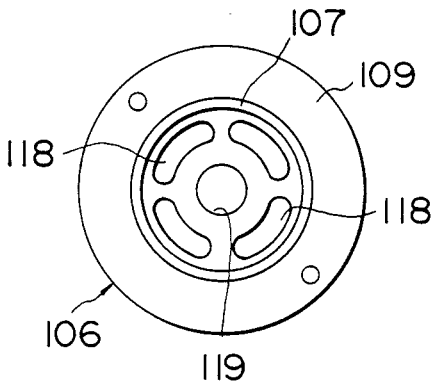
FIG. 18 is a plan view of an anchor member used in the mechanism of FIG. 15.
Figure 19:
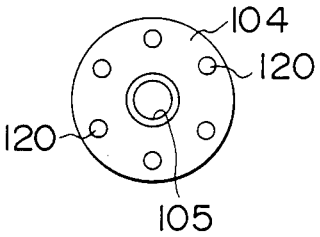
FIG. 19 is a plan view of a lower nut member used in the mechanism of FIG. 15.

FIGS. 15 and 16 show another embodiment of the invention. This embodiment will be described primarily with reference to its difference from the foregoing embodiment.

A fixing plate 101 is disposed within a cylindrical member 102 having a smaller diameter and fixed thereto. A screw member 103 of bolt type is fixed to the fixing plate 101 at its center so as to project upward along the axis of the fixing plate 101. A lower nut member 104 is equipped at its center with a screw hole 105 bores so as to mate with the screw member 103. The lower nut member 104 has a circular shape so that is can be loosely fitted into the cylindrical member 102. Reference numeral 106 represents an anchor member which comprises a cylindrical body 107 equipped at its bottom end with an anchor portion 108, and a flange 109 formed at and around the upper end of the cylindrical body 107. The anchor bottom portion has four circular-arc slots 118 around a central though hole 119. The outer diameter of the cylindrical body 107 is sized so that it can be closely fitted into the cylindrical member 102, and the outer diameter of the flange 109 is sized so that it can be supported on the upper surface of the cylindrical member 110 having a greater diameter. The flange 109 is fixed to the upper surface 111*a* of the element 111 by screws 112. Reference numeral 113 represents an upper nut member, which is equipped at its center with a screw hole 114 to mate with the screw member 103. The nut member 113 can be loosely fitted into the body 107 of the anchor member 106. Reference numeral 115 represents stair unit, and numeral 116 represents a unit cover, and numeral 117 represents a level adjusting plate.

The action of the FIGS. 15 and 16 embodiments will now be described.

When the assembly is started from the upper unit, the lower nut member 104 is screwed with the screw member 103 of the cylindrical member 102 of the lower stair unit 115, and then rotated so that the height from the upper surface of the nut member 104 to the upper surface the level adjusting plate 117 of the lower unit is set to a desired height ($h_2$). The lower stair unit 115 thus adjusted is then inserted from below into the cylindrical member 110 the upper stair unit 115 which is fixed to the further upper stair unit. The upper nut member 113 is screwed with the screw member 103 from above the anchor member 106, so as to engage the upper and lower stair units 115, 115 with each other. Next, the lower stair unit 115 is rotated to adjust the angle, and then fastened temporarily.

The same procedures are repeated to complete the temporary assembly, and the difference between the dimension on the drawing and dimension at the site of assembly or the error occuring at the time of assembly is distributed to each stair unit 115 in the same way as in the foregoing embodiment, that is to say, by rotating the lower nut member 104 through the slots 118 of the anchor member 106 by an operating handle similar to said handle 30, which is inserted into holes 120 of nut member 104. After the height ($h_2$) and the angle ($\beta$) are finely adjusted in this manner, the upper nut member 113 is screwed and fixed to complete the final assembly.

In this embodiment, as the cylindrical member 102 is inserted into the cylindrical member 110 over the substantially entire inner circumferential surface thereof, any shake or eccentricity of, axes will not occur even when the stair units 115 are fixed to one another. Furthermore, as the downward force is always applied to the anchor member 106 in the embodiment described above, the anchor member 106 may be held in such a manner as not to move downward without being fixed to the upper stair unit 115. This makes it easy to insert the cylindrical member 102 into the cylindrical member 110.

In the above embodiment, a rubber packing 121 of ring-type is fitted on the screw member 103, and held between the upper surface of the nut member 104 and the lower surface of the anchor member 106. Thus, frictional forces acting between the packing 121 and said surfaces can prevent the lower stair unit 115 from undesignedly rotating when the upper nut member 113 is tightly fastened.

Futhermore, in the above embodiment, one or more set screws 122 are screwed into screw holes 123 of the fixing plate 101 through the holes holes 120 of the lower nut member 104 after the height of the nut member 104 is determined. The set screws 122 can prevent the nut member 104 from rotating and changing its height. This also contributes to prevent undesirable change of the angle displacement of stair units.

In this embodiment described above, the level adjusting plate 117 is put on the upper surface 111*a* of the element 11, and fixed to the element 111 by four set screws 124. The screws 124 are screwed into screw holes 125 of the level adjusting plate 117 and screw holes 126 of the element 111, which screw holes 125 and 126 are disposed on both sides of the cylindrical member 102 and 110 symmetrically. Thus, it is possible to incline the level adjusting plate 117 in relation to the element 111 by rotating suitable set screws 124. Accordingly, when the element 111 is inclined to the horizontal or standard plane, the level adjusting plate 117 can be brought to the predetermined horizontal position by the screw rotation described above.

In accordance with the present invention, since the (rough) adjustment of height can be made for each stair unit and a pair of nut members clamp the anchor members between them so that the stair units can be rotated under the hanged state, the angle adjustment of the stair units and fixing of them can be carried out very surely and safely. Thus, the assembly work becomes extremely easy and efficient. Especially when the assembly is started from the upper unit, each stair unit is not likely to drop so that there is no necessity of disposing any support below each stair unit until the temporary assembly is completed. Thus, the number of assembly steps can be remarkably reduced.

Furthermore, the present invention makes it extremely easy to carry out the fine adjustment at the time of final assembly after rough adjustment at the time of temporary assembly, that has been extrimely difficult to realize in the prior art. Accordingly, the present invention provides an extremely great practical advantage.

What is claimed is:

1. A stair unit of the type utilizing two cylindrical members, one of which has an outer diameter smaller than the inner diameter of the other cylindrical member, are juxtaposed in a spaced-apart relation in the vertical direction and an element is disposed between said cylindrical members so as to provide a fixing mechanism for stair units, comprising:

a screw member disposed on the axis of said cylindrical member having a smaller diameter and rotatably fixed to the cylindrical member;

an anchor member rigidly fixed to said cylindrical member having a greater diameter; and upper and lower nut members constituted so that said lower nut member can be rotated through an opening in said upper nut member.

2. A stair unit of the type in which two cylindrical members, one of which has an outer diameter smaller than the inner diameter of the other member, are juxtaposed in a spaced-apart relation in the vertical direction and an element is disposed between both of said cylindrical members, so as to provide a fixing mechanism for stair units, comprising:

a screw member disposed on the axis of said cylindrical member having a smaller diameter and fixed to the cylindrical member;

an anchor member rigidly fixed to one of said cylindrical members; and a pair of nut members mating with said screw member and clamping said anchor member from above and below between said nut members.

3. The fixing mechanism as defined in claim 2, wherein: said pair of nut members are constituted so that a lower nut member can be rotated through an opening in an upper nut member.

4. A fixing mechanism as defined in claim 2, wherein: said anchor member is ring-shaped and is fixed to the inner circumference of said cylindircal member having a greater diameter.

5. A fixing mechanisam as defined in claim 2, wherein: said anchor means is a plate fixed to said cylindrical member having a smaller diameter.

* * * * *